United States Patent [19]

Price

[11] Patent Number: 4,513,886

[45] Date of Patent: Apr. 30, 1985

[54] APPARATUS FOR FEEDING ADHESIVE IN ROD FORM

[75] Inventor: Frank C. Price, Leicester, England

[73] Assignee: USM Corporation, Farmington, Conn.

[21] Appl. No.: 459,385

[22] Filed: Jan. 20, 1983

[30] Foreign Application Priority Data

Jan. 21, 1982 [GB] United Kingdom ..... 8201704

[51] Int. Cl.[3] ..... B67D 5/62

[52] U.S. Cl. ..... 222/146.5

[58] Field of Search ..... 198/747, 772; 414/14, 414/160, 198, 750; 221/66; 222/146 HE, 146 H

[56] References Cited

U.S. PATENT DOCUMENTS

| | | | |
|---|---|---|---|
| 3,262,583 | 7/1966 | Thevenet | 414/14 |
| 3,774,817 | 11/1973 | Whittaker | 222/146 HE |
| 4,289,257 | 9/1981 | Herb et al. | 222/146 HE |
| 4,379,516 | 4/1983 | Barlogis | 222/146 HE |

*Primary Examiner*—Joseph E. Valenza
*Assistant Examiner*—Kyle E. Shane
*Attorney, Agent, or Firm*—Donald N. Halgren

[57] ABSTRACT

The rod feed apparatus is made up of a number of telescoping tubes. A first tube (16) is fixed in the apparatus frame and has a connection (46) for a flexible pipe by which it is connected to a melt chamber. A guide tube (36) has a sliding fit with and can slide in the tube (16), the guide tube being secured to a lead-in tube (32) which is clamped inside a support tube (18), the support tube (18) being arranged to slide on the outside of the first tube (16). Rod adhesive is supplied through the lead-in tube (34), into the guide tube (36) and then to the first tube (16). The guide tube is thin-walled so that effectively the rod has a sliding fit with the internal bore of each of the three tubes referred to. For feeding the rod, a jaw (38) projects through slots in the support tube (18) and lead-in tube (32) and is mounted for movement with the various tubes (18, 32, 36). In operation, as the jaw and tubes referred to are advanced, the guide tube passing inside the fixed tube (16), while as they are retracted, a further jaw member (42) grips the adhesive rod and prevents its return movement therewith.

The apparatus is suitable for use especially, but not exclusively, with machines for performing lasting operations on shoe bottoms, wherein adhesive is applied progressively along side portions of the shoe bottoms prior to operation of lasting instrumentalities thereof.

7 Claims, 1 Drawing Figure

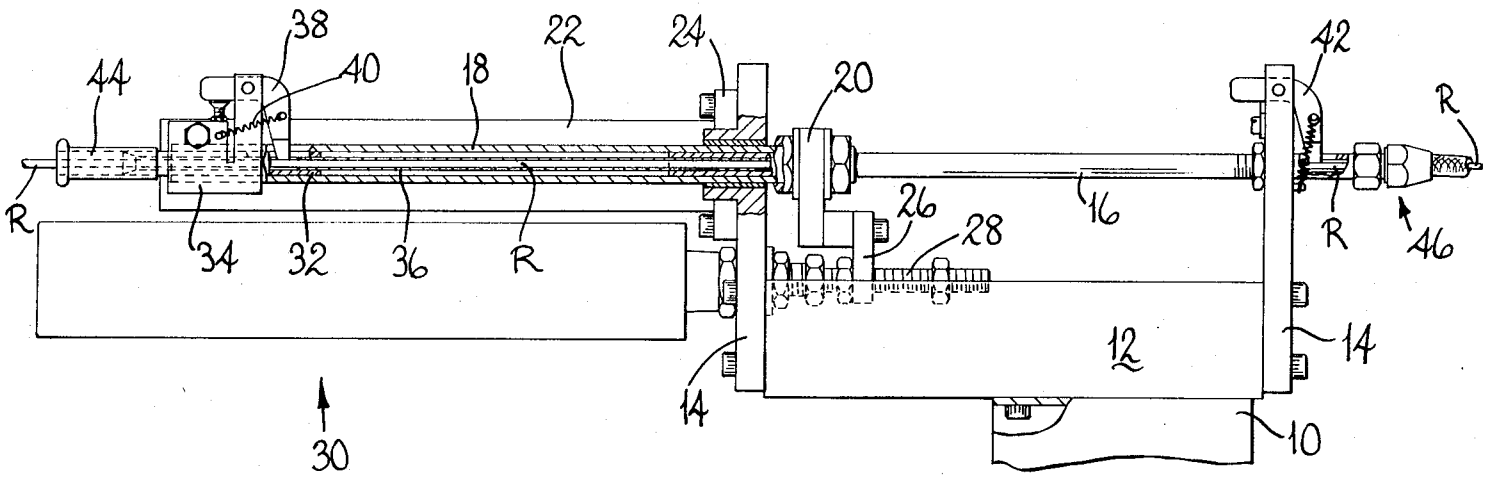
R
46
42
R
14
10
12
16
28
26
20
24
14
22
R
18
36
40
38
32
30
34
44
R

APPARATUS FOR FEEDING ADHESIVE IN ROD FORM

BACKGROUND OF THE INVENTION (1) Field of the Invention

This invention is concerned with apparatus for feeding adhesive in rod form progressively to a melt chamber, said apparatus comprising a first tubular portion through which a rod of adhesive can pass and be guided thereby and which can be connected to a melt chamber, and a device by which the rod of adhesive can be engaged and which is movable, between a retracted and an advanced position, relative to the first tubular portion, whereby to feed the portion of adhesive rod accommodated in the latter to the melt chamber.

(2) Prior Art

Apparatus is described in U.K. Patent Specification No. 1301275, in which apparatus the first tubular portion is provided with opposed slots, in which opposed jaws of the rod-engaging device can project to grip on a rod of adhesive accommodated in the tubular portion. Apart from the expense of machining the slots in the tubular portion, however, the provision of such slots from time to time proves detrimental in that they so weaken the tubular portion that, in the event of an obstruction arising therein, with consequent buckling of the rod of adhesive, the tubular portion itself may be distorted.

In another proposed apparatus for feeding adhesive in rod form (see e.g. U.S. Pat. No. 3,743,142), the adhesive rod is gripped at its position spaced from the tubular portion and, as the rod-engaging device is advanced towards the first tubular portion, the adhesive is fed therethrough. The adhesive rod is unsupported, however, in such an arrangement between the gripper and the "upstream" end of the first tubular portion, and in some instances the possibility therefore arises of a blockage taking place in the first tubular portion with a result that the unsupported portion of the rod becomes buckled. In such an instance, the buckled rod can then no longer be fed, and the unit has to be cleared of adhesive before its use can be continued.

It is the object of the present invention to provide an improved apparatus for feeding adhesive in rod form, in the operation of which the risk of buckling of the rod is minimized, control of the rod being however, achieved using relatively inexpensive components.

BRIEF SUMMARY OF THE INVENTION

In accordance with the present invention, therefore, in an apparatus as set out in the first paragraph above, a second tubular portion is mounted for movement with the rod-engaging device relative to the first tubular portion, through which second tubular portion the adhesive rod can pass and which provides a sliding fit with said rod, the external dimensions of the second tubular portion being less than the internal dimensions of the first tubular portion, and the arrangement being such that, with the rod-engaging device in its retracted position, the "downstream" end of the second tubular portion is accommodated within the "upstream" end of the first tubular portion and, as the rod-engaging device moves to its advanced position, the second tubular portion slides within the first tubular portion.

With such an arrangement, it will be appreciated that, over substantially the whole of its length "downstream" of the rod-engaging device, the adhesive rod is accommodated within one or other of the first or second tubular portions, so that the risk of buckling of the rod is minimized. Furthermore, any suitable tubular material may be used, and further, since neither portion has slots provided therein, no special machining of the material prior to use is required.

In order to provide a relatively close fit between not only the second tubular portion and the rod, but also the first tubular portion and the rod, preferably the second tubular portion is thin-walled, more particularly has a wall thickness of the order of 0.015" (0.38 mm) and has a sliding fit with said first tubular portion.

For supporting the second tubular portion at its "upstream" end, a third tubular portion may also be provided, which also is moveable with the rod-engaging member relative to the first tubular portion, through which also the adhesive rod can pass and the bore of which is aligned with that of the second tubular portion. The third tubular portion effectively therefore provides a lead-in for the leading end portion of each new rod of adhesive which is to be fed using the apparatus in accordance with the invention. Furthermore, conveniently the third tubular portion is slotted, the rod-engaging device comprising a jaw member which can project through the slot to engage with the portion of adhesive rod accommodated in the said third tubular portion. Preferably the "downstream" end of the third tubular portion is thus slotted; the tolerances of such a slot are not critical and, furthermore, since one slot only is to be provided, problems of alignment (which arose in the case of the provision of opposed slots) are avoided. It is also to be noted that, in accordance with the present invention, a single jaw member only is sufficient, because of the relatively close tolerances between the rod and the tubular portions through which it is to be fed, for purposes of gripping and feeding the rod.

For moving the rod-engaging device and the various tubular portions therewith between retracted and advanced positions as aforesaid, an arrangement may conveniently be used wherein the external dimensions of the third tubular portion are greater than those of the second tubular portion, the second and third tubular portions are accommodated within a fourth tubular portion, the internal dimensions of which are such as to form a clamping fit with the third tubular portion, and the fourth tubular portion is also moveable with the rod-engaging device relative to the third tubular portion, the internal dimensions of the fourth tubular portion being greater than the external dimensions of the first tubular portion, and the arrangement being such that, as the rod-engaging device moves as aforesaid relative to the first tubular portion, the fourth tubular portion slides over the outside of said first tubular portion. In this way, therefore, the fourth tubular portion provides a general guide for the various moveable components of the apparatus in accordance with the invention.

Furthermore, the "upstream" end of the fourth tubular portion may also be slotted, the slots therein being aligned with the slots formed in said third tubular portion, whereby the jaw member of the rod-engaging device can project through both slots, and further a clamp device may be provided by which the slotted portions of the third and fourth tubular portions can be clamped together. In addition, the rod-engaging device may be supported on the fourth tubular portion, fluid pressure operated means being connected to said fourth tubular portion for moving it, and the rod-engaging device and also the second and third tubular portions therewith, relative to the first tubular portion as aforesaid. In such an arrangement, furthermore, conveniently the clamp device may carry the rod-engaging device.

It will thus be appreciated that the apparatus in accordance with the present invention affords a reliable feed arrangement for rod adhesive, utilizing relatively inexpensive components, while at the same time providing an enhanced control of the adhesive rod over substantially the whole of its length extending from the rod-engaging device to the connection with the melt chamber, such control serving to minimize any risk of buckling of the rod. Furthermore, because of the relatively close tolerances between the rod and the various tubular portions through which it passes, the leading end portion of a next-to-be-fed rod can be used to push the trailing end of the last-fed rod through the apparatus without any significant risk of the opposed ends engaging side-by-side within any tubular portion with a consequent risk of jamming.

BRIEF DESCRIPTION OF THE DRAWING

There now follows a detailed description, to be read with reference to the accompanying drawing, of one apparatus in accordance with the invention. It will of course be appreciated that this apparatus has been selected for description merely by way of exemplification of the invention and not by way of limitation thereof.

The accompanying drawing shows a side view, partly in section, of the apparatus of the invention.

DESCRIPTION OF THE PREFERRED EMBODIMENT

The apparatus in accordance with the invention is suitable for use in shoe making machines, more especially, but not exclusively, machines for performing lasting operations on shoe bottoms wherein adhesive is applied progressively along marginal portions of a shoe bottom prior to the operation of lasting instrumentalities of the machine. In such machines, usually two adhesive-applying nozzles are provided, for operating along each side of the shoe bottom, and to this end the apparatus in accordance with the invention has two feed heads (one only of which can be seen in the drawing) arranged side-by-side, each head having its own adhesive rod supplied and being arranged to feed adhesive rod from such supply to its own associated melt chamber.

The apparatus in accordance with the invention comprises a base plate 10, by which it can be mounted on an appropriate machine, the base plate 10 supporting, along opposite sides thereof, two wall portions 12 which are in turn connected, at opposite ends thereof, to, and support, two upstanding wall portions 14, providing support for opposite ends of two tubes 16 (one only seen in the drawing), arranged side-by-side and being associated one with each feed head. Each tube 16 is fixedly secured to the right-hand wall portion 14 (viewing the drawing).

The left hand end of each tube 16 projects into the bore of a further tube 18, each tube 18 being mounted for sliding movement in a sleeved aperture formed in the left hand upstanding wall portion 14, the external dimensions of each tube 16 being less than the internal dimensions of the further tube 18 associated therewith, and providing a sliding fit therebetween. For effecting the sliding movement of the further tubes 18, a cross-member 20 extends between the right hand ends thereof, to the right (viewing the drawing) of the left hand upstanding wall portion 14, and to said cross-member is connected a piston rod (not shown) of a cylinder 22 which is carried by a bracket 24 secured to the left hand face of the left hand upstanding wall portion 14, the piston rod projecting through an aperture formed in said wall portion. For controlling the rate of movement of the further tubes 18, furthermore, a bracket 26 is secured centrally of the cross-member 20 and is connected to a piston rod 28 of a hydraulic check arrangement generally designated 30. This arrangement 30 is of a conventional type.

Accommodated in the left hand ("upstream") end of each further tube 18 is a lead-in tube 32, the external dimensions of which are such as to provide a clamping fit with the internal bore of its associated further tube 18. In addition, the left hand end of each further tube 18 is slotted and the "downstream" end of each lead-in tube 32 is slotted, the slots being aligned with one another, a bifurcated clamp device generally designated 34 being provided which, when tightened, clamps the slotted end of the further tube 18 onto the slotted end of the lead-in tube 32 associated therewith. The internal bore of each lead-in tube 32, furthermore, is so dimensioned that a rod of adhesive can pass therethrough.

Secured in the "downstream" end of each lead-in tube 32 is the "upstream" end of a guide tube 36. Any suitable adhesive may be utilized for securing the guide tube 36 as aforesaid. The "downstream" end of each tube 36, furthermore, is supported in, and provides a sliding fit with, the internal bore of its associated tube 16. The guide tube has a thin wall, of the order of 0.015" (0.38 mm), and thus its internal bore is such as to accommodate rod adhesive therein with a sliding fit also.

The guide tube 36, lead-in tube 32 and further tube 18 of each feed head constitute respectively second, third and fourth tubular portions of the apparatus in accordance with the invention.

It will be appreciated that the rod of adhesive to be fed by the apparatus in accordance with the invention thus passes through the lead-in tube 32, into the guide tube 36 and then extends through the tube 16. Thus, the tubes through which the rod adhesive pass all maintain a sliding fit with the rod adhesive, so that any tendency of the rod to buckle, even in the event of an obstruction "downstream" of the apparatus, can be eliminated.

For feeding rod adhesive along the various tubes referred to of each feed head, a jaw member 38 is pivotally mounted on the clamp device 34 of each head and projects through the slots formed in the further tube 18 and lead-in tube 32, thus to engage with rod adhesive in the lead-in tube 32. The jaw member 38 is urged into rod-engaging condition by a spring 40, and of course as the further tube member 18, together with the lead-in tube 32, guide tube 36 and the clamping device 34, are urged to the right (viewing the drawing) by operation of the cylinder 22, the tendency of the jaw by engagement with the rod, is to press the rod more firmly against the portion in the lead-in tube opposite the slot therein, thus securely to clamp the rod in the tubes for feeding as aforesaid. On the return movement of the various tubes and jaw member, on the other hand, the tendency is for the rod to cam the jaw member out of clamping engagement with the rod, so that there is no tendency to retract the adhesive rod during the return movement. A further jaw member 42 is also provided, pivotally mounted on the right hand upstanding wall portion 14, and spring-urged into engagement with the rod, projecting through a slotted "downstream" end portion of the tube 16 for that purpose, this further jaw member being effective, during the retracting movement of the further tube 18, to grip into the rod and press it against the face, opposite the slot, of the tube 16, thus to hold it in position, while, during the advancing movement of the further tube 18, the further jaw member 42 is cammed by the rod out of gripping engagement therewith.

The lead-in end of the lead-in tube 32 has a hollow cap 44 of plastic material, thus to prevent significant scraping of the rod as it enters the apparatus in accordance with the invention. The "downstream" end of the tube 16 of each feed head, furthermore, has a connection 46 by which the apparatus in accordance with the invention can be connected to a melt chamber, e.g. by means of flexible piping (not shown).

In using the apparatus in accordance with the invention, the operator feeds a leading end portion of a rod supply through the hollow cap 44 and into the lead-in tube 32, past the jaw member 38, which is held in engagement with the rod thus inserted by means of the spring 40, and preferably sufficiently far along the guide tube 36 that it projects therebeyond into the tube 16. At this stage, of course, the apparatus is in its retracted condition, as shown in the drawing. The operator then initiates a cycle of operation of the apparatus, wherein a pressure fluid is supplied to cylinder 22 to cause the further tube 28, and thus the jaw member 38, the lead-in tube 32 and the guide tube 36 associated therewith, to move to the right (viewing the drawing) so that the guide tube is caused to slide within, and the further tube outside, the tube 16, rod adhesive being at the same time drawn from the supply. The hydraulic check arrangement 30 not only checks the speed of traverse of the further tube 18, but also limits the stroke thereof; alternatively, conventional adjustable mechanical stop means may be provided for so limiting the stroke. When the further tube 18 reaches the end of its stroke, constituting the advanced condition of the apparatus, the guide tube 36 has passed along a major proportion of the tube 16, carrying therewith the leading end portion of the adhesive rod. On the return movement, the leading end (assuming it has reached and further jaw member 42) is held by said further jaw member, and the guide tube 36, and lead-in tube 32 are then retracted, together with the further tube 18 and the jaw member 38, without disturbing the lengthwise position of the rod. In practice, it may be necessary to effect two or more cycles of the apparatus by way of "priming", before a full supply of adhesive is provided at the melt chamber. Of course, once the priming is completed, in each cycle of operation of the apparatus in accordance with the invention, a measured quantity of adhesive is advanced to the melt chamber. Furthermore, because of the relatively close tolerances of the internal bores on the various tubes, in relation to the adhesive passing therethrough, the leading end of a new supply can be used to push against the trailing end of a previous supply, thus to provide a continuous feed, but without any significant risk of the two ends becoming lodged side-by-side and causing an obstruction in the tubes.

I claim:

1. An apparatus for feeding adhesive in rod form progressively to a melt chamber, comprising:

a first tubular portion through which a rod of adhesive can pass and be guided thereby and which can be connected to a melt chamber, and a device by which the rod of adhesive can be engaged and which is movable, between a retracted and an advanced position, relative to the first tubular portion, whereby to fed the portion of adhesive rod accommodated in the latter to the melt chamber, characterized in that a second tubular portion is mounted for movement with the rod-engaging device relative to the first tubular portion, through which second tubular portion the adhesive rod can pass and which provides a sliding fit with said rod, and in that the external dimensions of the first tubular portion, the arrangement being such that, with the rod-engaging device in its retraced position, the downstream end of the second tubular portion is accommodated with the upstream end of the first tubular portion, and, as the rod-engaging device moves to its advanced position, the second tubular portion slides within the first tubular portion, the second tubular portion being supported at its upstream end by a third tubular portion, which also is movable with the rod-engaging member relative to the first tubular portion, through which also the adhesive rod can pass and the bore of which is alinged with that of the second tubular portion to minimize obstruction of the adhesive rod therewithin.

2. An apparatus according to claim 1 characterized in that the second tubular portion has a wall thickness of the order of about 0.015" (0.38 mm) and has a sliding fit with said first tubular portion.

3. An apparatus according to claim 1 characterized in that said third tubular portion is slotted, and in that the rod-engaging device comprises a jaw member which can project through the slot to engage with the portion of adhesive rod accommodated in said tubular portion.

4. An apparatus according to claim 3 characterized in that the external dimensions of the third tubular portion are greater than those of the second tubular portion, in that the second and third tubular portions are accommodated within a fourth tubular portion, the internal dimensions of which are such as to form a clamping fit with the third tubular portion, and in that the fourth tubular portion is also movable with the rod-engaging device relative to the first tubular portion, the internal dimensions of the fourth tubular portion being greater than the external dimensions of the first tubular portion, and the arrangement being such that, as the rod-engaging device moves as aforesaid relative to the first tubular portion, the fourth tubular portion slides over the outside of said first tubular portion.

5. An apparatus according to claim 4 characterized in that the "upstream" end of the fourth tubular portion is slotted, the slot therein being aligned with the slot formed in said third tubular portion, whereby the jaw member of the rod-engaging device can project through both slots, and in that a clamp device is provided by which the slotted portions of the third and fourth tubular portions can be clamped together.

6. An apparatus according to claim 5 characterized in that the rod-engaging device is supported on the fourth tubular portion, and in that fluid pressure operated means is connected to the fourth tubular portion for moving it, and thus the rod-engaging device and also the second and third tubular portions therewith, relative to the first tubular portion as aforesaid.

7. An apparatus according to claim 6 characterized in that said clamp device carries the rod-engaging driven.

* * * * *